US010734728B2

(12) United States Patent
Pan

(10) Patent No.: US 10,734,728 B2
(45) Date of Patent: Aug. 4, 2020

(54) ANTENNA, ANTENNA CONTROL METHOD, ANTENNA CONTROL APPARATUS, AND ANTENNA SYSTEM

(71) Applicant: Huawei Technologies Co., Ltd., Shenzhen (CN)

(72) Inventor: Xin Pan, Wuhan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 346 days.

(21) Appl. No.: 15/754,545

(22) PCT Filed: Aug. 27, 2015

(86) PCT No.: PCT/CN2015/088227
§ 371 (c)(1),
(2) Date: Feb. 22, 2018

(87) PCT Pub. No.: WO2017/031741
PCT Pub. Date: Mar. 2, 2017

(65) Prior Publication Data
US 2018/0254561 A1 Sep. 6, 2018

(51) Int. Cl.
*H01Q 9/04* (2006.01)
*H01Q 1/50* (2006.01)
(Continued)

(52) U.S. Cl.
CPC ..... *H01Q 9/0457* (2013.01); *H01Q 1/38* (2013.01); *H01Q 1/50* (2013.01); *H01Q 3/24* (2013.01);
(Continued)

(58) Field of Classification Search
CPC ..... H01Q 3/24; H01Q 21/29; H01Q 1/38; H01Q 9/065; H01Q 9/0435; H01Q 9/0457; H01Q 1/50
See application file for complete search history.

(56) References Cited

U.S. PATENT DOCUMENTS 3,691,556 A * 9/1972 Bloice ..... G01S 13/56 342/27
6,130,602 A * 10/2000 O'Toole ..... H03L 7/0995 340/10.33
(Continued)

FOREIGN PATENT DOCUMENTS

CN 1220525 A 6/1999
CN 1266292 A 9/2000
(Continued)

OTHER PUBLICATIONS

Machine Translation and Abstract of Chinese Publication No. CN1220525, Jun. 23, 1999, 8 pages.
(Continued)

*Primary Examiner* — Graham P Smith
*Assistant Examiner* — Jae K Kim
(74) *Attorney, Agent, or Firm* — Conley Rose, P.C.

(57) ABSTRACT

An antenna, an antenna control method, an antenna control apparatus, and an antenna system, where the antenna includes a feeding part and at least two oscillators, and a circuit with a variable inductance value is disposed between any oscillator and the feeding part. When the inductance value of the circuit between the oscillator and the feeding part is zero the oscillator is used as an excitation oscillator. When the inductance value is greater than zero, the oscillator is used as an excited oscillator. Any oscillator may be used as an excitation oscillator or an excited oscillator. The antenna can implement full coverage on a horizontal plane and has a relatively high gain.

20 Claims, 7 Drawing Sheets

(51) Int. Cl.

| | |
|---|---|
| ***H01Q 1/38*** | (2006.01) |
| ***H01Q 3/24*** | (2006.01) |
| ***H01Q 21/29*** | (2006.01) |
| ***H01Q 9/06*** | (2006.01) |

(52) U.S. Cl.
CPC ..... *H01Q 9/0435* (2013.01); *H01Q 9/065* (2013.01); *H01Q 21/29* (2013.01)

(56) References Cited

U.S. PATENT DOCUMENTS

| | | | | |
|---|---|---|---|---|
| 6,337,668 | B1 | 1/2002 | Ito et al. | |
| 8,395,485 | B2 * | 3/2013 | Wuidart ..... | G06K 7/10158 340/10.4 |
| 2002/0105471 | A1 | 8/2002 | Kojima et al. | |
| 2004/0027304 | A1 | 2/2004 | Chiang et al. | |
| 2014/0354510 | A1 | 12/2014 | Li et al. | |
| 2015/0295322 | A1 | 10/2015 | Asanuma et al. | |
| 2016/0241075 | A1 * | 8/2016 | Von Novak, III ..... | H02J 7/025 |

FOREIGN PATENT DOCUMENTS

| | | | |
|---|---|---|---|
| CN | 1381078 | A | 11/2002 |
| CN | 1792006 | A | 6/2006 |
| CN | 102013559 | A | 4/2011 |
| CN | 102823060 | A | 12/2012 |
| CN | 103579781 | A | 2/2014 |
| CN | 103700942 | A | 4/2014 |
| WO | 2015108644 | A1 | 7/2015 |

OTHER PUBLICATIONS

Foreign Communication From a Counterpart Application, Chinese Application No. 201580078333.9, Chinese Office Action dated Mar. 27, 2019, 9 pages.

Machine Translation and Abstract of Chinese Publication No. CN102013559, Apr. 13, 2011, 14 pages.

Machine Translation and Abstract of Chinese Publication No. CN103700942, Apr. 2, 2014, 12 pages.

Foreign Communication From a Counterpart Application, PCT Application No. PCT/CN2015/088227, English Translation of International Search Report dated May 27, 2016, 3 pages.

Foreign Communication From a Counterpart Application, PCT Application No. PCT/CN2015/088227, English Translation of Written Opinion dated May 27, 2016, 8 pages.

* cited by examiner

ANTENNA, ANTENNA CONTROL METHOD, ANTENNA CONTROL APPARATUS, AND ANTENNA SYSTEM

CROSS-REFERENCE TO RELATED APPLICATION

This application is a U.S. National Stage of International Patent Application No. PCT/CN2015/088227 filed on Aug. 27, 2015, which is hereby incorporated by reference in its entirety.

TECHNICAL FIELD

Embodiments of the present disclosure relate to the field of antenna technologies, and in particular, to an antenna, an antenna control method, an antenna control apparatus, and an antenna system.

BACKGROUND

Currently, receiving and emission of a radio signal is usually implemented using an antenna. In an actual application process, requirements for an antenna are different according to different application scenarios.

There are special requirements for an antenna in many application scenarios. For example, in a smart home system, a user terminal may be distributed at any position of a home. To ensure that all user terminals can implement communication, an antenna needs to implement full coverage on a horizontal plane. Moreover, obstructions such as walls may be disposed between user terminals. To ensure reliability of communication, the antenna also needs to have a high gain. It can be known from the foregoing that in many application scenarios, an antenna needs to implement full coverage on a horizontal plane and also needs to have a relatively high gain.

However, an antenna usually used in some other approaches includes a directional antenna and an omnidirectional antenna. The directional antenna has a relatively high gain in a specific direction but cannot implement full coverage on a horizontal plane. The omnidirectional antenna can implement full coverage on a horizontal plane but has a relatively small gain. Therefore, implementation of an antenna that can implement full coverage on a horizontal plane and has a relatively high gain is a difficulty in researches.

SUMMARY

Embodiments of the present disclosure provide an antenna, an antenna control method, an antenna control apparatus, and an antenna system such that the antenna can implement full coverage on a horizontal plane and has a relatively high gain.

According to a first aspect, an embodiment of the present disclosure provides an antenna, including a feeding part and at least two oscillators, where a first circuit with a variable inductance value is disposed between a first oscillator of the at least two oscillators and the feeding part, and a second circuit with a variable inductance value is disposed between a second oscillator of the at least two oscillators and the feeding part, when the inductance value of the first circuit is 0, and the inductance value of the second circuit is a first inductance value, the first oscillator is used as an excitation oscillator, and the second oscillator is used as an excited oscillator, and when the inductance value of the first circuit is a second inductance value, and the inductance value of the second circuit is 0, the first oscillator is used as an excited oscillator, and the second oscillator is used as an excitation oscillator, where the excitation oscillator is configured to receive a signal from the feeding part and emit the signal, and the excited oscillator is configured to reflect or direct the signal.

With reference to the first aspect, in a first possible implementation manner of the first aspect, the first circuit and the second circuit are respectively either of the circuits, a circuit including an adjustable inductance line, where an adjustable inductor is disposed on the adjustable inductance line, and a circuit including a first line and a second line, where an inductance value of the first line is 0, an inductance value of the second line is greater than 0, and the circuit including the first line and the second line can be switched between the first line and the second line.

With reference to the first possible implementation manner of the first aspect, in a second possible implementation manner of the first aspect, the circuit including the first line and the second line further includes a third line, an inductance value of the third line is greater than 0 and is different from the inductance value of the second line, and a circuit including the first line, the second line, and the third line can be switched among the first line, the second line, and the third line.

With reference to the first possible implementation manner of the first aspect, in a third possible implementation manner of the first aspect, the circuit including the adjustable inductance line is configured to receive control information, and adjust an inductance value of the adjustable inductor according to the control information.

With reference to the first possible implementation manner of the first aspect, in a fourth possible implementation manner of the first aspect, the first line and the second line are disposed in parallel, the feeding part is connected to a non-movable end of a single-pole, double-throw switch, and a movable end of the single-pole, double-throw switch can be connected to the first line or the second line, and the single-pole, double-throw switch is configured to receive control information, and select, according to the control information, to connect the movable end of the single-pole, double-throw switch to the first line or the second line.

With reference to the second possible implementation manner of the first aspect, in a fifth possible implementation manner of the first aspect, the first line, the second line, and the third line are disposed in parallel, one end of the feeding part is connected to a non-movable end of a single-pole, triple-throw switch, and a movable end of the single-pole, triple-throw switch can be connected to any one of the first line, the second line, or the third line, and the single-pole, triple-throw switch is configured to receive control information, and select, according to the control information, to connect the movable end of the single-pole, triple-throw switch to any one of the first line, the second line, or the third line.

With reference to any one of the first aspect or the first possible implementation manner of the first aspect to the fifth possible implementation manner of the first aspect, in a sixth possible implementation manner of the first aspect, that when the inductance value of the first circuit is 0, and the inductance value of the second circuit is a first inductance value, the first oscillator is used as an excitation oscillator, and the second oscillator is used as an excited oscillator, and that when the inductance value of the first circuit is a second inductance value, and the inductance value of the second circuit is 0, the first oscillator is used as an excited oscillator, and the second oscillator is used as an excitation oscillator include that when the inductance value of the first circuit is 0, and the inductance value of the second circuit is a first value of the first inductance value, the first oscillator is used as an excitation oscillator, and the second oscillator is used as a reflector oscillator, and when the inductance value of the first circuit is a first value of the second inductance value, and the inductance value of the second circuit is 0, the first oscillator is used as a reflector oscillator, and the second oscillator is used as an excitation oscillator, when the inductance value of the first circuit is 0, and the inductance value of the second circuit is a first value of the first inductance value, the first oscillator is used as an excitation oscillator, and the second oscillator is used as a reflector oscillator, and when the inductance value of the first circuit is a second value of the second inductance value, and the inductance value of the second circuit is 0, the first oscillator is used as a director oscillator, and the second oscillator is used as an excitation oscillator, when the inductance value of the first circuit is 0, and the inductance value of the second circuit is a second value of the first inductance value, the first oscillator is used as an excitation oscillator, and the second oscillator is used as a director oscillator, and when the inductance value of the first circuit is a first value of the second inductance value, and the inductance value of the second circuit is 0, the first oscillator is used as a reflector oscillator, and the second oscillator is used as an excitation oscillator, when the inductance value of the first circuit is 0, and the inductance value of the second circuit is a second value of the first inductance value, the first oscillator is used as an excitation oscillator, and the second oscillator is used as a director oscillator, and when the inductance value of the first circuit is a second value of the second inductance value, and the inductance value of the second circuit is 0, the first oscillator is used as a director oscillator, and the second oscillator is used as an excitation oscillator, where the first value of the first inductance value is greater than the second value of the first inductance value, and the first value of the second inductance value is greater than the second value of the second inductance value.

With reference to any one of the first aspect or the first possible implementation manner of the first aspect to the sixth possible implementation manner of the first aspect, in a seventh possible implementation manner of the first aspect, the oscillator is a dipole oscillator.

With reference to the seventh possible implementation manner of the first aspect, in an eighth possible implementation manner of the first aspect, the dipole oscillator includes an upper-part metal sheet and a lower-part metal sheet, and the upper-part metal sheet and the lower-part metal sheet are symmetric and are not connected, the upper-part metal sheet includes a left lobe and a right lobe, the left lobe and the right lobe are symmetric, and a lower right corner of the left lobe and a lower left corner of the right lobe are connected using a connection portion, and an upper edge and a lower edge of the left lobe are parallel, a length of the lower edge is greater than a length of the upper edge, a left edge of the left lobe is separately vertical to the upper edge and the lower edge, and a right edge of the left lobe is a convex curve.

With reference to any one of the first aspect or the first possible implementation manner of the first aspect to the eighth possible implementation manner of the first aspect, in a ninth possible implementation manner of the first aspect, a difference value between the first value of the first inductance value and the second value of the first inductance value is $$\frac{X}{2\pi f},$$

where X is a reactance of the oscillator, and f is a frequency of the antenna.

With reference to any one of the first aspect or the first possible implementation manner of the first aspect to the eighth possible implementation manner of the first aspect, in a tenth possible implementation manner of the first aspect, a difference value between the first value of the second inductance value and the second value of the second inductance value is $$\frac{X}{2\pi f},$$

where X is a reactance of the oscillator, and f is a frequency of the antenna.

With reference to any one of the first aspect or the first possible implementation manner of the first aspect to the tenth possible implementation manner of the first aspect, in an eleventh possible implementation manner of the first aspect, the multiple oscillators are disposed in an array.

With reference to the eleventh possible implementation manner of the first aspect, in a twelfth possible implementation manner of the first aspect, a quantity of the multiple oscillators is 3, and the three oscillators are arranged in a triangle, or a quantity of the multiple oscillators is greater than 3, the multiple oscillators except a third oscillator are uniformly distributed around the third oscillator, and the third oscillator is any oscillator of the multiple oscillators.

According to a second aspect, an embodiment of the present disclosure provides an antenna control method, applied to a first terminal including an antenna, where the antenna includes a feeding part and at least two oscillators, a circuit with a variable inductance value is separately disposed between each of the oscillators and the feeding part, and the method includes obtaining a signal quality of a signal received by a user terminal, where the signal is sent by the antenna in a current antenna status, obtaining a preset antenna status when determining that the signal quality is less than a preset quality threshold, where the preset antenna status includes statuses of the oscillators in the antenna, and sending control information to the circuits with the variable inductance values according to the statuses of the oscillators in the preset antenna status, where the control information is used to instruct the circuits with the variable inductance values to adjust the inductance values in order to switch statuses of the oscillators to the statuses of the oscillators in the preset antenna status.

With reference to the second aspect, in a first possible implementation manner of the second aspect, after determining that the signal quality is less than a preset quality threshold, the method further includes setting the current antenna status to an invalid antenna status, where the obtaining a preset antenna status includes obtaining an antenna status with a highest priority from valid antenna statuses and setting the antenna status with the highest priority to the preset antenna status.

With reference to the first possible implementation manner of the second aspect, in a second possible implementation manner of the second aspect, the method further includes setting all antenna statuses to valid antenna statuses when determining that the signal quality is greater than the preset quality threshold.

With reference to the second aspect, the first possible implementation manner of the second aspect, or the second possible implementation manner of the second aspect, in a third possible implementation manner of the second aspect, an adjustable inductance line is disposed on the circuit with the variable inductance value, and an adjustable inductor is disposed on the adjustable inductance line, and correspondingly, the control information includes a first target inductance value, and the control information is used to instruct the circuit with the variable inductance value to adjust the adjustable inductor on the adjustable inductance line to the first target inductance value.

With reference to the second aspect, the first possible implementation manner of the second aspect, or the second possible implementation manner of the second aspect, in a fourth possible implementation manner of the second aspect, the circuit with the variable inductance value includes a first line and a second line, the first line and the second line are disposed in parallel, an inductance value of the first line is 0, an inductance value of the second line is greater than 0, the feeding part is connected to a non-movable end of a single-pole, double-throw switch, and a movable end of the single-pole, double-throw switch can be connected to the first line or the second line, and correspondingly, the control information includes an identifier of a first target line, and the control information is used to instruct the movable end of the single-pole, double-throw switch to connect to the first target line.

With reference to the second aspect, the first possible implementation manner of the second aspect, or the second possible implementation manner of the second aspect, in a fifth possible implementation manner of the second aspect, the circuit with the variable inductance value includes a first line, a second line, and a third line, the first line, the second line, and the third line are disposed in parallel, an inductance value of the first line is 0, an inductance value of the second line and an inductance value of the third line are both greater than 0, the inductance value of the second line is different from the inductance value of the third line, the feeding part is connected to a non-movable end of a single-pole, double- or triple-throw switch, and a movable end of the single-pole, triple-throw switch can be connected to any one of the first line, the second line, and the third line, and correspondingly, the control information includes an identifier of a second target line, and the control information is used to instruct the movable end of the single-pole, triple-throw switch to connect to the second target line.

According to a third aspect, an embodiment of the present disclosure provides an antenna control apparatus, where an antenna controlled by the antenna control apparatus includes a feeding part and at least two oscillators, a circuit with a variable inductance value is disposed between each of the oscillators and the feeding part, and the antenna control apparatus includes a first obtaining module configured to obtain a signal quality of a signal received by a user terminal, where the signal is sent by the antenna in a current antenna status, a second obtaining module configured to obtain a preset antenna status when the signal quality is less than a preset quality threshold, where the preset antenna status includes statuses of the oscillators in the antenna, and a sending module configured to send control information to the circuits with the variable inductance values according to the statuses of the oscillators in the preset antenna status, where the control information is used to instruct the circuits with the variable inductance values to adjust the inductance values in order to switch statuses of the oscillators to the statuses of the oscillators in the preset antenna status.

With reference to the third aspect, in a first possible implementation manner of the third aspect, the antenna control apparatus further includes a first setting module configured to set the current antenna status to an invalid antenna status, where correspondingly, the second obtaining module is further configured to obtain an antenna status with a highest priority from valid antenna statuses and set the antenna status with the highest priority to the preset antenna status.

With reference to the first possible implementation manner of the third aspect, in a second possible implementation manner of the third aspect, the antenna control apparatus further includes a second setting module configured to set all antenna statuses to valid antenna statuses when the signal quality is greater than the preset quality threshold.

With reference to the third aspect, the first possible implementation manner of the third aspect, or the second possible implementation manner of the third aspect, in a third possible implementation manner of the third aspect, an adjustable inductance line is disposed on the circuit with the variable inductance value, and an adjustable inductor is disposed on the adjustable inductance line, and the control information sent by the sending module to the circuit with the variable inductance value includes a first target inductance value, and the control information is used to instruct the circuit with the variable inductance value to adjust the adjustable inductor on the adjustable inductance line to the first target inductance value.

With reference to the third aspect, the first possible implementation manner of the third aspect, or the second possible implementation manner of the third aspect, in a fourth possible implementation manner of the third aspect, the circuit with the variable inductance value includes a first line and a second line, the first line and the second line are disposed in parallel, an inductance value of the first line is 0, an inductance value of the second line is greater than 0, the feeding part is connected to a non-movable end of a single-pole, double-throw switch, and a movable end of the single-pole, double-throw switch can be connected to the first line or the second line, and the control information sent by the sending module to the circuit with the variable inductance value includes an identifier of a first target line, and the control information is used to instruct the movable end of the single-pole, double-throw switch to connect to the first target line.

With reference to the third aspect, the first possible implementation manner of the third aspect, or the second possible implementation manner of the third aspect, in a fifth possible implementation manner of the third aspect, the circuit with the variable inductance value includes a first line, a second line, and a third line, the first line, the second line, and the third line are disposed in parallel, an inductance value of the first line is 0, an inductance value of the second line and an inductance value of the third line are both greater than 0, the inductance value of the second line is different from the inductance value of the third line, the feeding part is connected to a non-movable end of a single-pole, double- or triple-throw switch, and a movable end of the single-pole, triple-throw switch can be connected to any one of the first line, the second line, and the third line, and the control information sent by the sending module to the circuit with the variable inductance value includes an identifier of a second target line, and the control information is used to instruct the movable end of the single-pole, triple-throw switch to connect to the second target line.

According to a fourth aspect, an embodiment of the present disclosure provides an antenna system, including the antenna according to any one of the first aspect or possible implementation manners of the first aspect, the antenna control apparatus according to any one of the third aspect or possible implementation manners of the third aspect, and a radio frequency module connected to the antenna.

The antenna, the antenna control method, the antenna control apparatus, and the antenna system that are provided in the embodiments of the present disclosure include a feeding part and at least two oscillators. A first circuit with a variable inductance value is disposed between a first oscillator of the at least two oscillators and the feeding part, and a second circuit with a variable inductance value is disposed between a second oscillator of the at least two oscillators and the feeding part. When the inductance value of the first circuit is 0, and the inductance value of the second circuit is a first inductance value, the first oscillator is used as an excitation oscillator, and the second oscillator is used as an excited oscillator. When the inductance value of the first circuit is a second inductance value, and the inductance value of the second circuit is 0, the first oscillator is used as an excited oscillator, and the second oscillator is used as an excitation oscillator. Because any oscillator in the antenna can be used as an excitation oscillator or an excited oscillator, the antenna may include multiple different statuses. In an actual application process, one antenna status that makes a signal received by a user terminal have a highest quality may be selected from multiple statuses of the antenna according to an actual situation to emit the signal in a preset direction in order to improve a gain of the antenna and make the antenna implement full coverage on a horizontal plane.

BRIEF DESCRIPTION OF DRAWINGS

To describe the technical solutions in the embodiments of the present disclosure more clearly, the following briefly describes the accompanying drawings required for describing the embodiments. The accompanying drawings in the following description show some embodiments of the present disclosure, and persons of ordinary skill in the art may still derive other drawings from these accompanying drawings without creative efforts.

DESCRIPTION OF EMBODIMENTS

To make the objectives, technical solutions, and advantages of the embodiments of the present disclosure clearer, the following clearly describes the technical solutions in the embodiments of the present disclosure with reference to the accompanying drawings in the embodiments of the present disclosure. The described embodiments are some but not all of the embodiments of the present disclosure. All other embodiments obtained by persons of ordinary skill in the art based on the embodiments of the present disclosure without creative efforts shall fall within the protection scope of the present disclosure.

Figure 1:
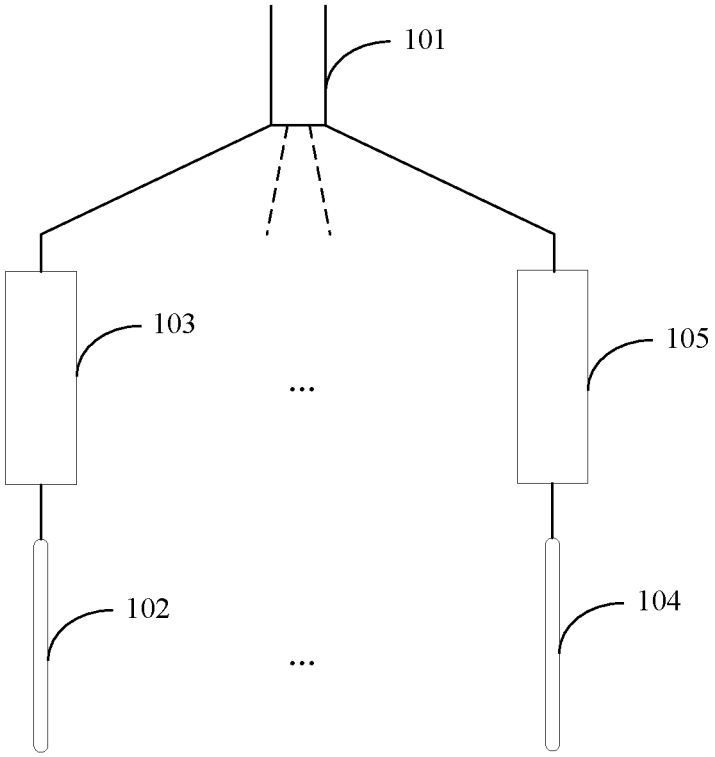
FIG. 1 is a schematic structural diagram of an antenna according to an embodiment of the present disclosure.

FIG. 1 is a schematic structural diagram of an antenna according to an embodiment of the present disclosure. Referring to FIG. 1, the antenna includes a feeding part 101 and at least two oscillators. A first circuit 103 with a variable inductance value is disposed between a first oscillator 102 of the at least two oscillators and the feeding part 101. A second circuit 105 with a variable inductance value is disposed between a second oscillator 104 of the at least two oscillators and the feeding part 101.

When the inductance value of the first circuit 103 is 0, and the inductance value of the second circuit 105 is a first inductance value, the first oscillator 102 is used as an excitation oscillator, and the second oscillator 104 is used as an excited oscillator. When the inductance value of the first circuit 103 is a second inductance value, and the inductance value of the second circuit 105 is 0, the first oscillator 102 is used as an excited oscillator, and the second oscillator 104 is used as an excitation oscillator. The excitation oscillator is configured to receive a signal from the feeding part 101 and emit the signal, and the excited oscillator is configured to reflect or direct the signal.

The first oscillator 102 and the second oscillator 104 in this embodiment of the present disclosure are any oscillator in the antenna. To facilitate describing the technical solution of this embodiment, the oscillators in the antenna are distinguished as the first oscillator 102 and the second oscillator 104. Oscillators described in the following embodiments of the present disclosure are any oscillator in the antenna and may be the first oscillator 102 or the second oscillator 104. In this embodiment, when the excitation oscillator is the first oscillator 102, the excited oscillator is the second oscillator 104. When the excited oscillator is the first oscillator 102, the excitation oscillator is the second oscillator 104.

In this embodiment shown in FIG. 1, any oscillator of the at least two oscillators in the antenna may be used as an excitation oscillator or an excited oscillator. The excited oscillator may be a reflector oscillator or a director oscillator. When the excited oscillator is a reflector oscillator, the excited oscillator is configured to reflect a signal. When the excited oscillator is a director oscillator, the excited oscillator is configured to direct a signal. In an actual application process, only one oscillator in the antenna is used as an excitation oscillator, and oscillators except the oscillator used as an excitation oscillator are all used as excited oscillators.

Because any oscillator in the antenna may be used an excitation oscillator or an excited oscillator (i.e., a reflector oscillator or a director oscillator), in the same antenna, when functions of the oscillators in the antenna are different, statuses of the antenna are also different. For example, assuming that the antenna includes two oscillators, respectively marked as an oscillator 1 and an oscillator 2, and the two oscillators may be both used as excitation oscillators, reflector oscillators, or director oscillators, the antenna includes four statuses.

Status 1: The oscillator 1 is an excitation oscillator, and the oscillator 2 is a reflector oscillator.

Status 2: The oscillator 1 is an excitation oscillator, and the oscillator 2 is a director oscillator.

Status 3: The oscillator 2 is an excitation oscillator, and the oscillator 1 is a reflector oscillator.

Status 4: The oscillator 2 is an excitation oscillator, and the oscillator 1 is a director oscillator.

In an actual application process, one antenna status that makes a signal received by a user terminal have a highest quality may be selected, according to an actual situation (for example, a position relationship between the user terminal and the antenna), from multiple statuses of the antenna using an antenna controller to emit the signal in order to improve a gain of the antenna in a direction of the user terminal. Further, because any oscillator in the antenna may be used as an excitation oscillator and may emit a signal in any radiation direction, the antenna can implement full coverage on a horizontal plane.

In an actual communication process, when a communication scenario changes, for example, a position of the user terminal changes, in order to ensure that a signal that is sent by the antenna and that is received by the user terminal has a relatively high quality, one antenna status that makes the signal received by the user terminal have a highest quality may be selected from multiple statuses of the antenna using an antenna controller to emit the signal. A specific application process of the antenna when a communication scenario changes in a communication process is described in detail using specific examples below.

Figure 2:
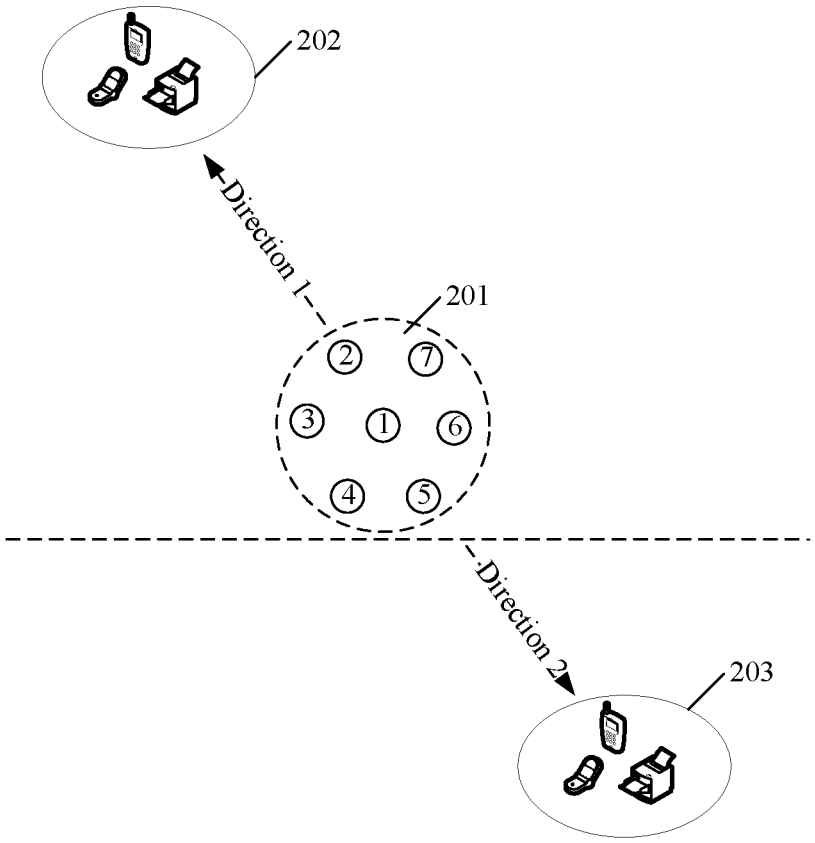
FIG. 2 is a schematic diagram of an application scenario of an antenna according to an embodiment of the present disclosure.

FIG. 2 is a schematic diagram of an application scenario of an antenna according to an embodiment of the present disclosure. Referring to FIG. 2, the scenario includes an antenna 201 and multiple user terminals. The antenna 201 includes seven oscillators, respectively marked as an oscillator 1 to an oscillator 7. A specific application process of the antenna after a user terminal moves from an area 202 to an area 203 in a communication process is described below in detail.

In a communication process, when the user terminal is located in the area 202, to ensure that a signal that is sent by the antenna 201 and that is received by the user terminal has a relatively high quality, an antenna controller uses the oscillator 1 as an excitation oscillator according to a position relationship between the area 202 at which the user terminal is located and the antenna 201, to emit the signal according to a direction 1 shown in FIG. 2. Moreover, the oscillator 2, the oscillator 3, and the oscillator 7 are used as director oscillators to direct the signal, and the oscillator 4, the oscillator 5, and the oscillator 6 are used as reflector oscillators to reflect the signal.

When the user terminal moves from the area 202 to the area 203, to ensure that the signal that is sent by the antenna 201 and that is received by the user terminal has a relatively high quality, the antenna controller uses the oscillator 1 as an excitation oscillator according to a position relationship between the area 203 at which the user terminal is located and the antenna 201, to emit the signal according to a direction 2 shown in FIG. 2. The oscillator 2, the oscillator 3, and the oscillator 7 are used as reflector oscillators to reflect the signal, and the oscillator 4, the oscillator 5, and the oscillator 6 are used as director oscillators to direct the signal.

It can be known from the foregoing process that the antenna 201 may emit signals in different directions and select an oscillator from excited oscillators to reflect or direct a signal such that the antenna 201 can implement full coverage on a horizontal plane and has a relatively high gain.

The antenna 201 provided in this embodiment of the present disclosure includes a feeding part and at least two oscillators. A first circuit with a variable inductance value is disposed between a first oscillator of the at least two oscillators and the feeding part, and a second circuit with a variable inductance value is disposed between a second oscillator of the at least two oscillators and the feeding part. When the inductance value of the first circuit is 0, and the inductance value of the second circuit is a first inductance value, the first oscillator is used as an excitation oscillator, and the second oscillator is used as an excited oscillator. When the inductance value of the first circuit is a second inductance value, and the inductance value of the second circuit is 0, the first oscillator is used as an excited oscillator, and the second oscillator is used as an excitation oscillator. Because any oscillator in the antenna 201 can be used as an excitation oscillator or an excited oscillator, the antenna 201 may include multiple different statuses. In an actual application process, one antenna status that makes a signal received by a user terminal have a highest quality may be selected from multiple statuses of the antenna 201 according to an actual situation to emit the signal in a preset direction in order to improve a gain of the antenna 201 and make the antenna 201 implement full coverage on a horizontal plane.

In an actual application process, a circuit with a variable inductance value may be disposed between each of the oscillators and the feeding part in the antenna 201 according to actual needs.

Figure 3:
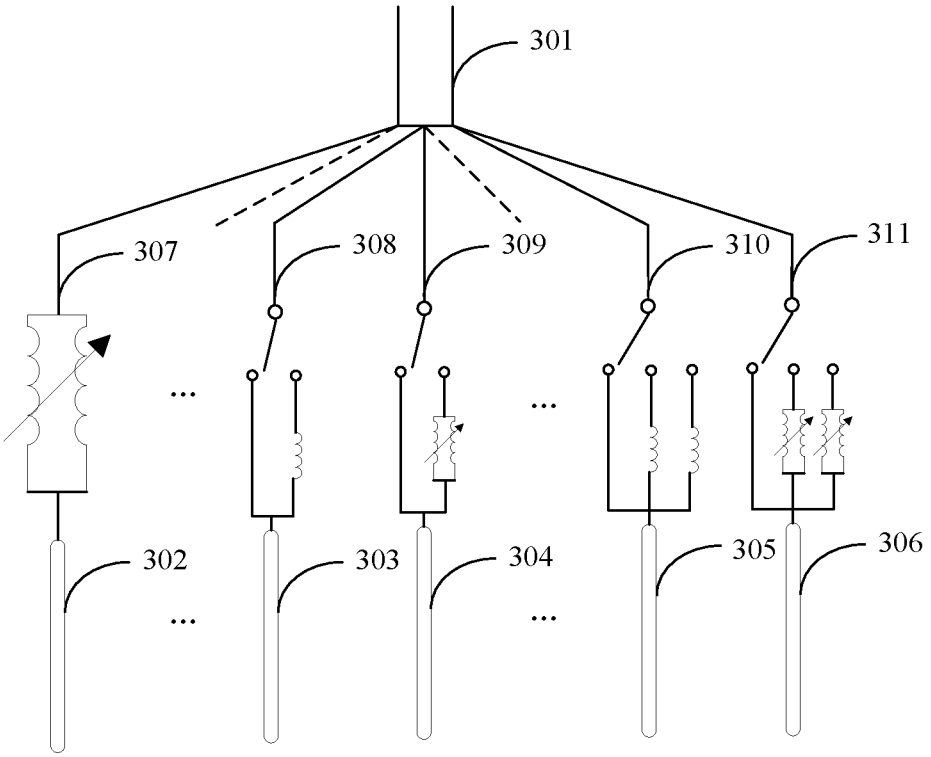
FIG. 3 is a schematic structural diagram of an antenna according to an embodiment of the present disclosure.

FIG. 3 is a schematic structural diagram of an antenna according to an embodiment of the present disclosure. Referring to FIG. 3, the antenna includes a feeding part 301 and at least two oscillators. The at least two oscillators include an oscillator 302, an oscillator 303, an oscillator 304, an oscillator 305, and an oscillator 306. A circuit with a variable inductance value between the oscillator 302 and the feeding part 301 is a circuit 307, a circuit with a variable inductance value between the oscillator 303 and the feeding part 301 is a circuit 308, a circuit with a variable inductance value between the oscillator 304 and the feeding part 301 is a circuit 309, a circuit with a variable inductance value between the oscillator 305 and the feeding part 301 is a circuit 310, a circuit with a variable inductance value between the oscillator 306 and the feeding part 301 is a circuit 311. The circuits 307-311 with the variable inductance values between the oscillators 302-306 and the feeding part 301 in the antenna are described in detail below with reference to FIG. 3.

One feasible implementation manner: Referring to the circuit 307 in FIG. 3, the circuit 307 is a circuit including an adjustable inductance line, and an adjustable inductor is disposed on the adjustable inductance line.

In this feasible implementation manner, the circuit 307 including the adjustable inductance line is configured to receive control information, and adjust an inductance value of the adjustable inductor according to the control information.

Optionally, the control information may include a target inductance value such that the circuit 307 adjusts the inductance value of the adjustable inductor to a first target inductance value. When the target inductance value is 0, the oscillator 302 connected to the circuit 307 is used as an excitation oscillator to emit a signal. When the target inductance value is greater than 0, the oscillator 302 connected to the circuit 307 is used as an excited oscillator to reflect or direct a signal.

Another feasible implementation manner: Referring to the circuit 308 and the circuit 309 in FIG. 3, the circuit 308 or the circuit 309 is a circuit including a first line and a second line. An inductance value of the first line is 0. An inductance value of the second line is greater than 0. The circuit 308 or the circuit 309 including the first line and the second line may be switched between the first line and the second line.

In this feasible implementation manner, the circuits 308 and 309 with the variable inductance values may be implemented using a single-pole, double-throw switch. The first line and the second line are disposed in parallel. The feeding part 301 is connected to a non-movable end of the single-pole, double-throw switch. A movable end of the single-pole, double-throw switch may be connected to the first line or the second line. The single-pole, double-throw switch is configured to receive control information, and select, according to the control information to connect the movable end of the single-pole, double-throw switch to the first line or the second line.

In the circuit 308, a fixed-value inductor is disposed on the second line. Correspondingly, the control information includes an identifier of a target line such that the single-pole, double-throw switch connects the movable end of the single-pole, double-throw switch to the target line according to the control information. In the circuit 309, a variable inductor is disposed on the second line. Correspondingly, when the target line is the second line, the control information further includes a target inductance value of the target line such that before the movable end of the single-pole, double-throw switch is connected to the second line, an inductance value of the variable inductor on the second line is adjusted to the target inductance value. When the target line is the first line, an oscillator connected to the single-pole, double-throw switch is used as an excitation oscillator, to emit a signal. When the target line is the second line, an oscillator connected to the single-pole, double-throw switch is used as an excited oscillator, to reflect or direct a signal.

Still another feasible implementation manner: Referring to the circuit 310 and the circuit 311 in FIG. 3, the circuit 310 or the circuit 311 is a circuit including a first line, a second line, and a third line. An inductance value of the first line is 0. An inductance value of the second line and an inductance value of the third line are greater than 0, and the inductance value of the second line is different from the inductance value of the third line. The circuit 310 or the circuit 311 including the first line, the second line, and the third line may be switched between the first line, the second line and the third line.

In this feasible implementation manner, the circuits 310 and 311 with the variable inductance values may be implemented using a single-pole, triple-throw switch. The first line, the second line, and the third line are disposed in parallel. One end of the feeding part 301 is connected to a non-movable end of the single-pole, triple-throw switch. A movable end of the single-pole, triple-throw switch may be connected to any one of the first line, the second line, or the third line. The single-pole, triple-throw switch is configured to receive control information, and select, according to the control information, to connect the movable end of the single-pole, triple-throw switch to any one of the first line, the second line, or the third line.

In the circuit 310, fixed-value inductors are disposed on the second line and the third line. Correspondingly, the control information includes an identifier of a target line such that the single-pole, triple-throw switch connects the movable end of the single-pole, triple-throw switch to the target line according to the control information. In the circuit 311, variable inductors are disposed on the second line and the third line. Correspondingly, when the target line is the second line or the third line, the control information further includes a target inductance value of the target line such that before the movable end of the single-pole, triple-throw switch is connected to the target line, inductance values of the variable inductors on the target line are adjusted to the target inductance value. When the target line is the first line, an oscillator connected to the single-pole, triple-throw switch is used as an excitation oscillator, to emit a signal. When the target line is the second line or the third line, an oscillator connected to the single-pole, triple-throw switch is used as an excited oscillator, to reflect or direct a signal. When an oscillator is connected to the feeding part 301 using the second line and is used as a reflector oscillator, the oscillator is connected to the feeding part 301 using the third line and is used as a director oscillator. When an oscillator is connected to the feeding part 301 using the second line and is used as a director oscillator, the oscillator is connected to the feeding part 301 using the third line and is used as a reflector oscillator.

It should be noted that in this implementation manner, further, a fixed-value inductor may be disposed on one of the second line or the third line, and a variable inductor may be disposed on the other one. This may be set according to actual needs in an actual application process and is not limited in the present disclosure.

Persons skilled in the art may understand that in an actual application process, the circuit disposed between each of the oscillators and the feeding part 301 in the antenna may be any one of the circuit 307, the circuit 308, the circuit 309, the circuit 310, or the circuit 311 shown in FIG. 3.

In any one of the foregoing embodiments, the excited oscillator includes a reflector oscillator and a director oscillator. For the first oscillator and the second oscillator of the at least two oscillators, when the first oscillator is the excited oscillator, if values of the second inductance value in the first circuit are different, functions of the first oscillator are different. Further, when the second inductance value in the first circuit is a first value of the second inductance value, the first oscillator is used as a reflector oscillator. When the second inductance value in the first circuit is a second value of the second inductance value, the first oscillator is used as a director oscillator. The second value of the first inductance value is greater than the second value of the second inductance value.

When the second oscillator is the excited oscillator, if values of the first inductance value in the second circuit are different, functions of the second oscillator are different. Further, when the first inductance value in the second circuit is a first value of the first inductance value, the second oscillator is used as a reflector oscillator. When the first inductance value in the second circuit is a second value of the first inductance value, the second oscillator is used as a director oscillator. The first value of the first inductance value is greater than the second value of the first inductance value.

Functions of the oscillators in the antenna when values of the second inductance value in the first circuit and the first inductance value in the second circuit are different are described in detail below.

One feasible implementation manner: When the inductance value of the first circuit is 0, and the inductance value of the second circuit is the first value of the first inductance value, the first oscillator is used as an excitation oscillator, and the second oscillator is used as a reflector oscillator. When the inductance value of the first circuit is the first value of the second inductance value, and the inductance value of the second circuit is 0, the first oscillator is used as a reflector oscillator, and the second oscillator is used as an excitation oscillator.

In this implementation manner, the first oscillator may be an excitation oscillator or a reflector oscillator, and the second oscillator may be an excitation oscillator or a reflector oscillator.

Another feasible implementation manner: When the inductance value of the first circuit is 0, and the inductance value of the second circuit is the first value of the first inductance value, the first oscillator is used as an excitation oscillator, and the second oscillator is used as a reflector oscillator. When the inductance value of the first circuit is the second value of the second inductance value, and the inductance value of the second circuit is 0, the first oscillator is used as a director oscillator, and the second oscillator is used as an excitation oscillator.

In this implementation manner, the first oscillator may be an excitation oscillator or a director oscillator, and the second oscillator may be an excitation oscillator or a reflector oscillator.

Still another feasible implementation manner: When the inductance value of the first circuit is 0, and the inductance value of the second circuit is the second value of the first inductance value, the first oscillator is used as an excitation oscillator, and the second oscillator is used as a director oscillator. When the inductance value of the first circuit is the first value of the second inductance value, and the inductance value of the second circuit is 0, the first oscillator is used as a reflector oscillator, and the second oscillator is used as an excitation oscillator.

In this implementation manner, the first oscillator may be an excitation oscillator or a reflector oscillator, and the second oscillator may be an excitation oscillator or a director oscillator.

Yet another feasible implementation manner: When the inductance value of the first circuit is 0, and the inductance value of the second circuit is the second value of the first inductance value, the first oscillator is used as an excitation oscillator, and the second oscillator is used as a director oscillator. When the inductance value of the first circuit is the second value of the second inductance value, and the inductance value of the second circuit is 0, the first oscillator is used as a director oscillator, and the second oscillator is used as an excitation oscillator.

In this implementation manner, the first oscillator may be an excitation oscillator or a director oscillator, and the second oscillator may be an excitation oscillator or a director oscillator.

Figure 4:
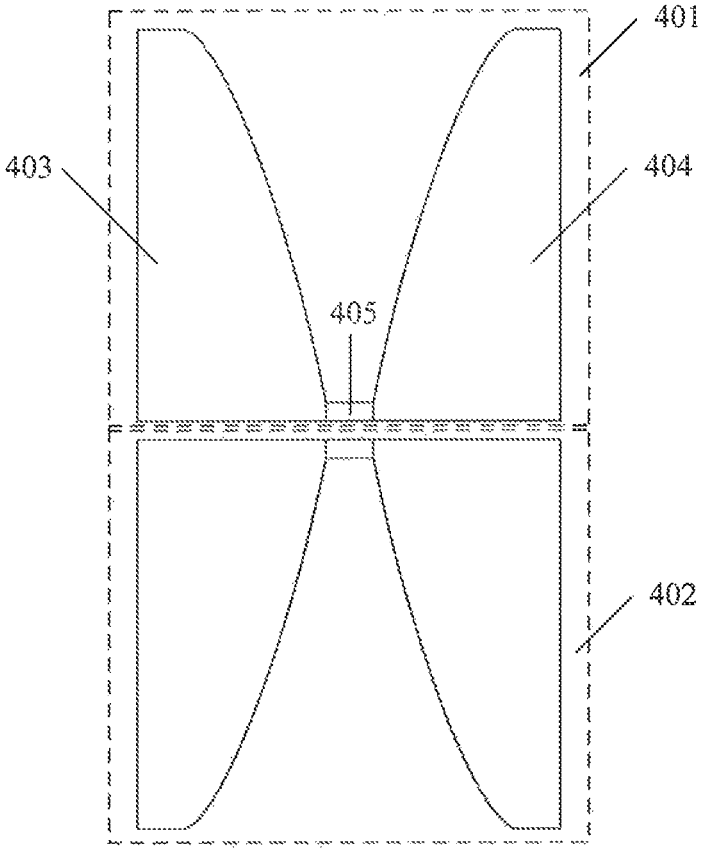
FIG. 4 is a schematic structural diagram of a dipole according to an embodiment of the present disclosure.

In any one of the foregoing embodiments, the oscillator in the antenna may be a dipole oscillator. FIG. 4 is a schematic structural diagram of a dipole according to an embodiment of the present disclosure. Referring to FIG. 4, the dipole oscillator includes an upper-part metal sheet 401 and a lower-part metal sheet 402. The upper-part metal sheet 401 and the lower-part metal sheet 402 are symmetric and are not connected. The upper-part metal sheet 401 includes a left lobe 403 and a right lobe 404. The left lobe 403 and the right lobe 404 are symmetric. A lower right corner of the left lobe 403 and a lower left corner of the right lobe 404 are connected using a connection portion 405. An upper edge and a lower edge of the left lobe 403 are parallel. A length of the lower edge is greater than a length of the upper edge. A left edge of the left lobe 403 is separately vertical to the upper edge and the lower edge, and a right edge of the left lobe 403 is a convex curve.

It should be noted that FIG. 4 only schematically shows a shape of the dipole oscillator using an example and is not a limitation to the shape of the dipole oscillator. In an actual application process, the shape of the dipole oscillator may also be set according to actual needs.

Preferably, multiple oscillators are disposed in an array. The multiple oscillators may have different array setting manners.

One feasible array setting manner: A quantity of the multiple oscillators is 3, and the three oscillators are arranged in a triangle.

Figure 5A:
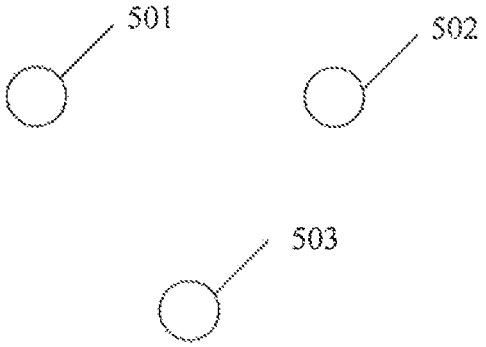
FIG. 5A is a schematic diagram of an array of antenna oscillators according to an embodiment of the present disclosure.

FIG. 5A is a schematic diagram of an array of antenna oscillators according to an embodiment of the present disclosure. Referring to FIG. 5A, the antenna includes three oscillators, respectively, an oscillator 501, an oscillator 502, and an oscillator 503. The three oscillators are arranged in a triangle.

In this array setting manner, any oscillator of the three oscillators 501-503 is an excitation oscillator, and the other two oscillators are both director oscillators or are both reflector oscillators according to different signal radiation directions.

An array of the antenna oscillators is described in detail below using that the antenna includes three oscillators as an example.

Figure 5B:
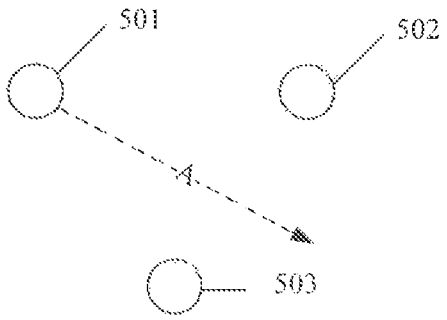
FIG. 5B is a schematic diagram of an array of antenna oscillators according to an embodiment of the present disclosure.

FIG. 5B is a schematic diagram of an array of antenna oscillators according to an embodiment of the present disclosure. Referring to FIG. 5B, the oscillator 501 is an excitation oscillator, and a signal radiation direction is shown by an arrow A in FIG. 5B. To increase a gain of the antenna, the oscillator 502 and the oscillator 503 are set to director oscillators to direct a signal.

Figure 5C:
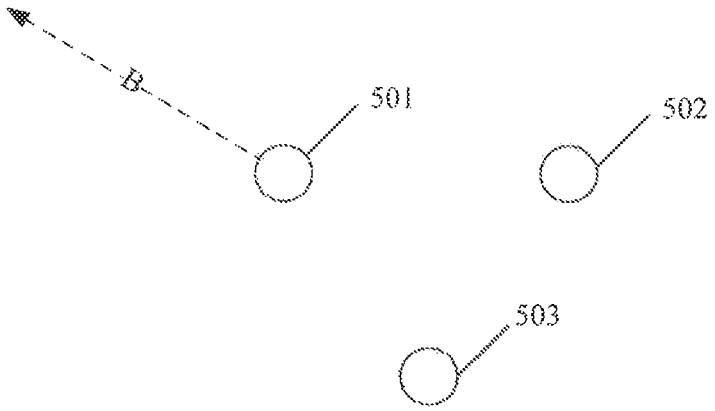
FIG. 5C is a schematic diagram of an array of antenna oscillators according to an embodiment of the present disclosure.

FIG. 5C is a schematic diagram of an array of antenna oscillators according to an embodiment of the present disclosure. Referring to FIG. 5C, the oscillator 501 is an excitation oscillator, and a signal radiation direction is shown by an arrow B in FIG. 5C. To increase a gain of the antenna, the oscillator 502 and the oscillator 503 are set to reflector oscillators to reflect a signal.

Another feasible array setting manner: A quantity of the multiple oscillators is greater than 3, the multiple oscillators except a third oscillator are uniformly distributed around the third oscillator, and the third oscillator is any oscillator of the multiple oscillators.

Figure 6A:
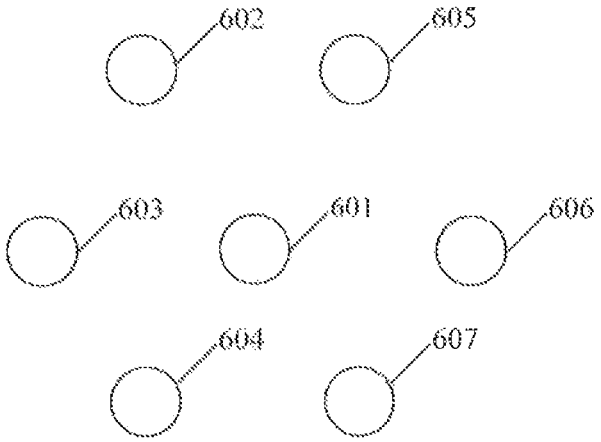
FIG. 6A is a schematic diagram of an array of antenna oscillators according to an embodiment of the present disclosure.

FIG. 6A is a schematic diagram of an array of antenna oscillators according to an embodiment of the present disclosure. Referring to FIG. 6A, the antenna includes seven oscillators, respectively an oscillator 601 to an oscillator 607. One oscillator of the seven oscillators is located at a center, and the other six oscillators are uniformly distributed on a circle with the oscillator as the center.

In this array setting manner, any oscillator of the seven oscillators is an excitation oscillator, and the other six oscillators are director oscillators or reflector oscillators according to different signal radiation directions.

An array of the antenna oscillators is described in detail below using that the antenna includes seven oscillators as an example.

Figure 6B:
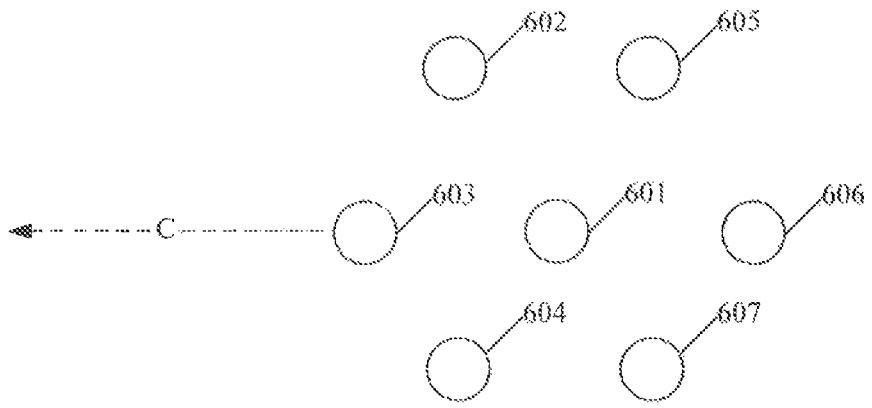
FIG. 6B is a schematic diagram of an array of antenna oscillators according to an embodiment of the present disclosure.

FIG. 6B is a schematic diagram of an array of antenna oscillators according to an embodiment of the present disclosure. Referring to FIG. 6B, the oscillator 601 is an excitation oscillator, and a signal radiation direction is shown by an arrow C in FIG. 6B. To increase a gain of the antenna, the oscillator 602, the oscillator 603, and the oscillator 604 are set to director oscillators to direct a signal. The oscillator 605, the oscillator 606, and the oscillator 607 are set to reflector oscillators to reflect a signal.

Figure 6C:
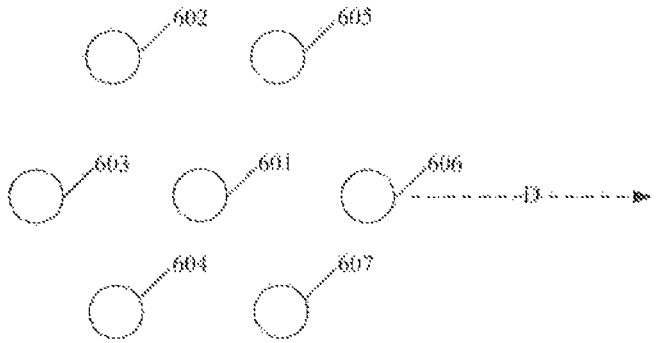
FIG. 6C is a schematic diagram of an array of antenna oscillators according to an embodiment of the present disclosure.

FIG. 6C is a schematic diagram of an array of antenna oscillators according to an embodiment of the present disclosure. Referring to FIG. 6C, the oscillator 601 is an excitation oscillator, and a signal radiation direction is shown by an arrow D in FIG. 6C. To increase a gain of the antenna, the oscillator 602, the oscillator 603, and the oscillator 604 are set to reflector oscillators to reflect a signal. The oscillator 605, the oscillator 606, and the oscillator 607 are set to director oscillators to direct a signal.

It should be noted that an array form of the oscillators in the antenna is only described above by way of example. Certainly, in an actual application process, the array form of the oscillators in the antenna may be set according to actual needs and is not limited in the present disclosure.

In the embodiment shown in FIG. 1, preferably, a difference value between the first value of the first inductance value and the second value of the first inductance value is $$\frac{X}{2\pi f},$$

and a difference value between the first value of the second inductance value and the second value of the second inductance value is $$\frac{X}{2\pi f}.$$

X is a reactance of the oscillator, and f is a frequency of the antenna.

Figure 7:
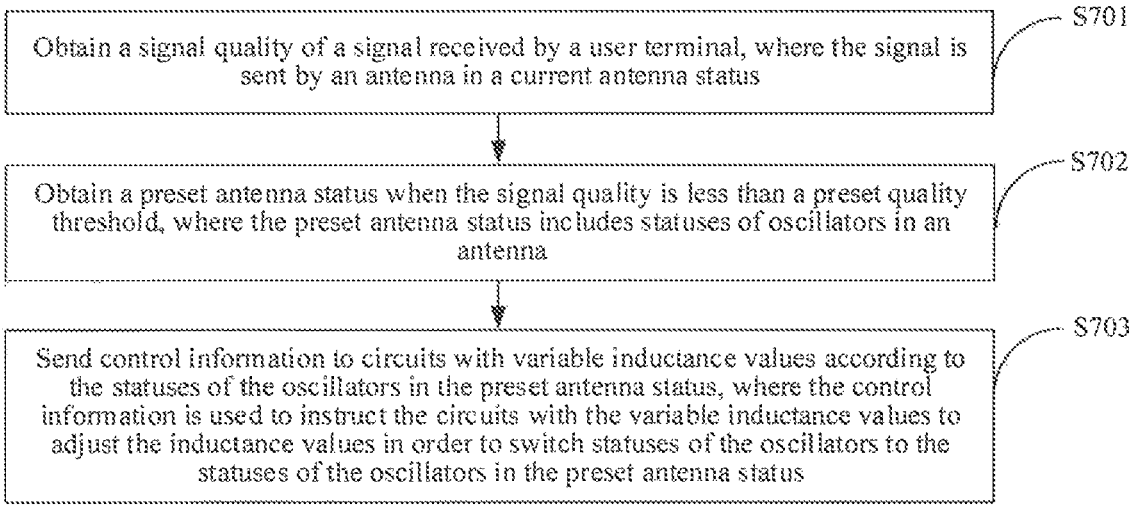
FIG. 7 is a schematic flowchart of an antenna control method according to an embodiment of the present disclosure.

FIG. 7 is a schematic flowchart of an antenna control method according to an embodiment of the present disclosure. An antenna in the method includes a feeding part and at least two oscillators. A circuit with a variable inductance value is disposed between each of the oscillators and the feeding part. An entity for executing the method is a first terminal including the antenna. The first terminal may be an antenna controller, a router, a gateway, or the like. The antenna controller may be implemented using software and/or hardware. Referring to FIG. 7, the method may include the following steps.

Step S701: Obtain a signal quality of a signal receive by a user terminal, where the signal is sent by the antenna in a current antenna status.

The user terminal is different from the entity for executing the method. The user terminal may be a mobile phone, a tablet computer, or the like.

Step S702: Obtain a preset antenna status when the signal quality is less than a preset quality threshold, where the preset antenna status includes statuses of the oscillators in the antenna.

Step S703: Send control information to the circuits with the variable inductance values according to the statuses of the oscillators in the preset antenna status, where the control information is used to instruct the circuits with the variable inductance values to adjust the inductance values in order to switch statuses of the oscillators to the statuses of the oscillators in the preset antenna status.

The antenna in the embodiment shown in FIG. 7 is the antenna according to any one of the foregoing embodiments. When functions of the oscillators in the antenna are different, statuses of the antenna are also different. In an actual application process, the first terminal obtains a signal quality of a signal sent by a user terminal receive antenna in a current antenna status and determines whether the signal quality is less than a preset threshold. If the signal quality is not less than the preset threshold, the current status of the antenna is not switched such that the antenna continues using the current status of the antenna to send a signal. If the signal quality is less than the preset threshold, a preset antenna status is obtained, and control information is sent to the circuits with the variable inductance values in the antenna such that the antenna switches the current antenna status to the preset antenna status such that the antenna sends a signal to the user terminal in the preset antenna status. When the antenna sends a signal in the preset antenna status, the foregoing process is repeated until it is determined that the signal quality of the signal sent by the user terminal receive antenna in the current status is greater than or equal to the preset threshold.

Optionally, the first terminal may perform the foregoing steps S701 to S703 in real time or periodically. If the first terminal performs the foregoing steps S701 to S703 periodically, period duration may be set according to actual needs.

In the antenna control method provided in this embodiment of the present disclosure, a signal quality of a signal received by a user terminal is obtained, and the signal is sent by an antenna in a current antenna status. A preset antenna status is obtained when the signal quality is less than a preset quality threshold. Control information is sent to circuits with variable inductance values according to statuses of oscillators in the preset antenna status, and the control information is used to instruct the circuits with the variable inductance values to adjust the inductance values in order to switch statuses of the oscillators to the statuses of the oscillators in the preset antenna status. A first terminal executes the foregoing method in real time or periodically. When a signal quality of a signal sent by a user terminal receive antenna in a current antenna status is less than a preset threshold, the control information is sent to the circuits with the variable inductance values in order to switch the current antenna status of the antenna to the preset antenna status, to ensure that the signal quality of the signal sent by the user terminal receive antenna is greater than the preset threshold. Consequently, a gain of the antenna is improved, and because the first terminal may emit a signal in any direction by selecting the preset antenna status of the antenna, the antenna can implement full coverage on a horizontal plane.

In the embodiment shown in FIG. 7, after it is determined that the signal quality is less than the preset quality threshold, the method further includes setting the current antenna status to an invalid antenna status.

Correspondingly, the preset antenna status may be obtained using the following possible implementation manner: An antenna status with a highest priority may be obtained from valid antenna statuses, and the antenna status with the highest priority is set to the preset antenna status.

All antenna statuses are set to valid antenna statuses when the signal quality of the signal sent in the current antenna status is greater than the preset quality threshold.

For example, it is assumed that the antenna includes five statuses, respectively marked as a status 1, a status 2, a status 3, a status 4, and a status 5. Priorities of the status 1 to the status 5 decrease progressively in sequence. In an initial status, the statuses 1 to 5 are all valid antenna statuses.

It is assumed that the current status of the antenna is the status 1. When the signal quality of the signal sent by the user terminal receive antenna in the status 1 is less than the preset threshold, the status 1 is set to an invalid status, the preset antenna status is determined in the valid antenna status 2 to status 5, and it is assumed that the status 2 is determined as the preset antenna status. In a next moment, the status 2 is determined as the current status. When the signal quality of the signal sent by the user terminal receive antenna in the status 2 is less than the preset threshold, the status 2 is set to an invalid status, and the preset antenna status is determined in the valid antenna status 3 to status 5. The foregoing process is repeated until it is determined that the signal quality of the signal sent by the user terminal receive antenna in the current status is greater than or equal to the preset threshold. In this case, all of the antenna statuses 1 to 5 are set to valid antenna statuses.

In an actual application process, according to different circuits with variable inductance values, content and functions included in the control information are also different. The content and functions included in the control information are described below in detail with respect to different circuits with variable inductance values.

One feasible implementation manner: An adjustable inductance line is disposed on the circuit with the variable inductance value, and an adjustable inductor is disposed on the adjustable inductance line.

Correspondingly, the control information includes a first target inductance value, the control information is used to instruct the circuit with the variable inductance value to adjust the adjustable inductor on the adjustable inductance line to the first target inductance value.

Another feasible implementation manner: The circuit with the variable inductance value includes a first line and a second line, the first line and the second line are disposed in parallel, an inductance value of the first line is 0, an inductance value of the second line is greater than 0, the feeding part is connected to a non-movable end of a single-pole, double-throw switch, and a movable end of the single-pole, double-throw switch can be connected to the first line or the second line.

Correspondingly, the control information includes an identifier of a first target line, and the control information is used to instruct the movable end of the single-pole, double-throw switch to connect to the first target line.

In this feasible implementation manner, if an inductor disposed on the second line is a variable inductor, the control information further includes a second target inductance value in order to adjust an inductance value of the variable inductor on the second line to the second target inductance value before the movable end of the single-pole, double-throw switch is connected to the second line.

Still another feasible implementation manner: The circuit with the variable inductance value includes a first line, a second line, and a third line, the first line, the second line, and the third line are disposed in parallel, an inductance value of the first line is 0, an inductance value of the second line and an inductance value of the third line are both greater than 0, the inductance value of the second line is different from the inductance value of the third line, the feeding part is connected to a non-movable end of a single-pole, double- or triple-throw switch, and a movable end of the single-pole, triple-throw switch can be connected to any one of the first line, the second line, and the third line.

Correspondingly, the control information includes an identifier of a second target line, and the control information is used to instruct the movable end of the single-pole, triple-throw switch to connect to the second target line.

In this feasible implementation manner, if an inductor disposed on the second line or the third line is a variable inductor, the control information further includes a third target inductance value in order to adjust an inductance value of the variable inductor on the second line or the third line to the third target inductance value before the movable end of the single-pole, triple-throw switch is connected to the second line or the third line.

Figure 8:
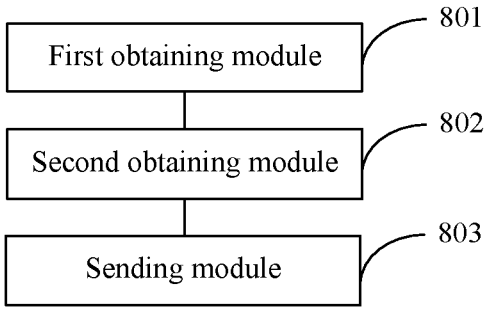
FIG. 8 is a schematic structural diagram of an antenna control apparatus according to an embodiment of the present disclosure.

FIG. 8 is a schematic structural diagram of an antenna control apparatus according to an embodiment of the present disclosure. An antenna controlled by the antenna control apparatus includes a feeding part and at least two oscillators, and a circuit with a variable inductance value is disposed between each of the oscillators and the feeding part. Referring to FIG. 8, the antenna control apparatus includes a first obtaining module 801 configured to obtain a signal quality of a signal received by a user terminal, where the signal is sent by the antenna in a current antenna status, a second obtaining module 802 configured to obtain a preset antenna status when the signal quality is less than a preset quality threshold, where the preset antenna status includes statuses of the oscillators in the antenna, and a sending module 803 configured to send control information to the circuits with the variable inductance values according to the statuses of the oscillators in the preset antenna status, where the control information is used to instruct the circuits with the variable inductance values to adjust the inductance values in order to switch statuses of the oscillators to the statuses of the oscillators in the preset antenna status.

Figure 9:
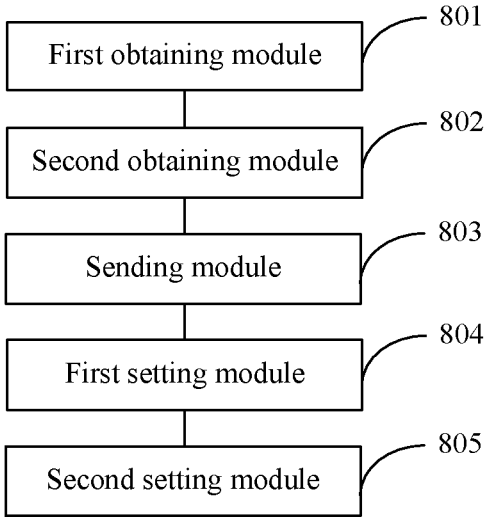
FIG. 9 is a schematic structural diagram of an antenna control apparatus according to an embodiment of the present disclosure.

FIG. 9 is a schematic structural diagram of an antenna control apparatus according to an embodiment of the present disclosure. Based on the embodiment shown in FIG. 8, referring to FIG. 9, the antenna control apparatus may further include a first setting module 804 configured to set the current antenna status to an invalid antenna status.

Correspondingly, the second obtaining module 802 may be further configured to obtain an antenna status with a highest priority from valid antenna statuses and set the antenna status with the highest priority to the preset antenna status.

Further, the antenna control apparatus further includes a second setting module 805 configured to set all antenna statuses to valid antenna statuses when the signal quality is greater than the preset quality threshold.

According to different circuits with variable inductance values, content and functions included in the control information sent by the sending module 803 to the circuits with the variable inductance values are also different.

One feasible implementation manner: An adjustable inductance line is disposed on the circuit with the variable inductance value, and an adjustable inductor is disposed on the adjustable inductance line, and the control information sent by the sending module 803 to the circuit with the variable inductance value includes a first target inductance value, and the control information is used to instruct the circuit with the variable inductance value to adjust the adjustable inductor on the adjustable inductance line to the first target inductance value.

Another feasible implementation manner: The circuit with the variable inductance value includes a first line and a second line, the first line and the second line are disposed in parallel, an inductance value of the first line is 0, an inductance value of the second line is greater than 0, the feeding part is connected to a non-movable end of a single-pole, double-throw switch, and a movable end of the single-pole, double-throw switch can be connected to the first line or the second line, and the control information sent by the sending module 803 to the circuit with the variable inductance value includes an identifier of a first target line, and the control information is used to instruct the movable end of the single-pole, double-throw switch to connect to the first target line.

Still another feasible implementation manner: The circuit with the variable inductance value includes a first line, a second line, and a third line, the first line, the second line, and the third line are disposed in parallel, an inductance value of the first line is 0, an inductance value of the second line and an inductance value of the third line are both greater than 0, the inductance value of the second line is different from the inductance value of the third line, the feeding part is connected to a non-movable end of a single-pole, double- or triple-throw switch, and a movable end of the single-pole, triple-throw switch can be connected to any one of the first line, the second line, and the third line, and the control information sent by the sending module 803 to the circuit with the variable inductance value includes an identifier of a second target line, and the control information is used to instruct the movable end of the single-pole, triple-throw switch to connect to the second target line.

Figure 10:
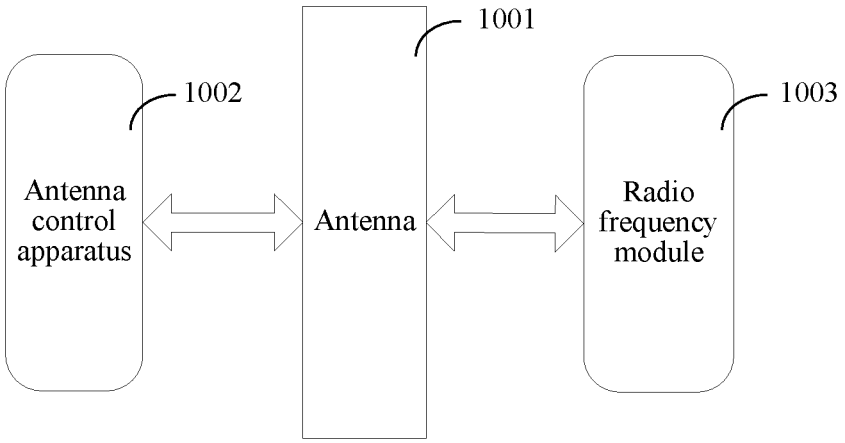
FIG. 10 is a schematic structural diagram of an antenna system according to an embodiment of the present disclosure.

FIG. 10 is a schematic structural diagram of an antenna system according to an embodiment of the present disclosure. Referring to FIG. 10, the antenna system includes the antenna 1001 according to any one of the foregoing embodiments, the antenna control apparatus 1002 according to any one of the foregoing embodiments, and a radio frequency module 1003 connected to the antenna 1001.

The antenna system shown in this embodiment has functions of the antenna according to any one of the foregoing embodiments. An implementation principle and technical effects of the antenna system are similar to those of the antenna and are not described again in this embodiment.

Finally, it should be noted that the foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present disclosure.

What is claimed is:

1. An antenna, comprising:

a feeding part;

a first oscillator;

a second oscillator;

a first circuit with a variable inductance value is disposed between the first oscillator and the feeding part; and a second circuit with another variable inductance value is disposed between the second oscillator and the feeding part, wherein the first circuit comprises a first line and a second line, wherein an inductance value of the first line comprises zero, wherein an inductance value of the second line is greater than zero, wherein the first circuit comprising the first line and the second line can be switched between the first line and the second line, wherein the second circuit comprises a third line and a fourth line, wherein an inductance value of the third line comprises zero, wherein an inductance value of the fourth line is greater than zero, wherein the second circuit comprising the third line and the fourth line can be switched between the third line and the fourth line, wherein the first oscillator comprises an excitation oscillator and the second oscillator comprises an excited oscillator when an inductance value of the first circuit comprises zero and an inductance value of the second circuit comprises a first inductance value, wherein the first oscillator comprises the excited oscillator and the second oscillator comprises the excitation oscillator when the inductance value of the first circuit comprises a second inductance value and the inductance value of the second circuit comprises zero, wherein the excitation oscillator is configured to:

receive a signal from the feeding part; and emit the signal, and wherein the excited oscillator is configured to:

reflect the signal when a signal radiation direction of the antenna is from the excitation oscillator and away from the excited oscillator; and direct the signal when the signal radiation direction of the antenna is from the excitation oscillator and towards the excited oscillator.

2. The antenna according to claim 1, wherein the first line and the second line are disposed in parallel, wherein the feeding part is coupled to a non-movable end of a single-pole, double-throw switch, wherein a movable end of the single-pole, double-throw switch can be coupled to the first line or the second line, and wherein the single-pole, double-throw switch is configured to:

receive control information; and select, according to the control information, to connect the movable end of the single-pole, double-throw switch to the first line or the second line.

3. The antenna according to claim 1, wherein the third line and the fourth line are disposed in parallel, wherein the feeding part is coupled to a non-movable end of a single-pole, double-throw switch, wherein a movable end of the single-pole, double-throw switch can be coupled to the third line or the fourth line, and wherein the single-pole, double-throw switch is configured to:

receive control information; and select, according to the control information to connect the movable end of the single-pole, double-throw switch to the third line or the fourth line.

4. The antenna according to claim 1, wherein the first oscillator comprises the excitation oscillator and the second oscillator comprises a reflector oscillator when the inductance value of the first circuit comprises zero and the inductance value of the second circuit comprises a first value of the first inductance value, wherein the first oscillator comprises the reflector oscillator and the second oscillator comprises the excitation oscillator when the inductance value of the first circuit comprises a first value of the second inductance value and the inductance value of the second circuit comprises zero, wherein the first value of the first inductance value is greater than a second value of the first inductance value, and wherein the first value of the second inductance value is greater than a second value of the second inductance value.

5. The antenna according to claim 1, wherein the first oscillator comprises the excitation oscillator and the second oscillator comprises a reflector oscillator when the inductance value of the first circuit comprises zero and the inductance value of the second circuit comprises a first value of the first inductance value, wherein the first oscillator comprises a director oscillator and the second oscillator comprises the excitation oscillator when the inductance value of the first circuit comprises a second value of the second inductance value and the inductance value of the second circuit comprises zero, wherein the first value of the first inductance value is greater than a second value of the first inductance value, and wherein a first value of the second inductance value is greater than the second value of the second inductance value.

6. The antenna according to claim 1, wherein the first oscillator comprises the excitation oscillator and the second oscillator comprises a director oscillator when the inductance value of the first circuit comprises zero and the inductance value of the second circuit comprises a second value of the first inductance value, wherein the first oscillator comprises a reflector oscillator and the second oscillator comprises the excitation oscillator when the inductance value of the first circuit comprises a first value of the second inductance value and the inductance value of the second circuit comprises zero, wherein a first value of the first inductance value is greater than the second value of the first inductance value, and wherein the first value of the second inductance value is greater than a second value of the second inductance value.

7. The antenna according to claim 1, wherein the first oscillator comprises the excitation oscillator and the second oscillator comprises a director oscillator when the inductance value of the first circuit comprises zero and the inductance value of the second circuit comprises a second value of the first inductance value, wherein the first oscillator comprises the director oscillator and the second oscillator comprises the excitation oscillator when the inductance value of the first circuit comprises a second value of the second inductance value and the inductance value of the second circuit comprises zero, wherein a first value of the first inductance value is greater than the second value of the first inductance value, and wherein a first value of the second inductance value is greater than the second value of the second inductance value.

8. The antenna according to claim 1, wherein the first oscillator or the second oscillator comprises a dipole oscillator.

9. The antenna according to claim 8, wherein the dipole oscillator comprises an upper-part metal sheet and a lower-part metal sheet, wherein the upper-part metal sheet and the lower-part metal sheet are symmetric and are not coupled, wherein the upper-part metal sheet comprises a left lobe and a right lobe, wherein the left lobe and the right lobe are symmetric, wherein a lower right corner of the left lobe and a lower left corner of the right lobe are coupled using a coupling portion, wherein an upper edge and a lower edge of the left lobe are in parallel, wherein a length of the lower edge is greater than a length of the upper edge, wherein a left edge of the left lobe is separately vertical to the upper edge and the lower edge, and wherein a right edge of the left lobe comprises a convex curve.

10. The antenna according to claim 1, wherein a difference value between a first value of the first inductance value and a second value of the first inductance value comprises $$\frac{X}{2\pi f},$$

wherein X comprises a reactance of the first oscillator, and wherein f comprises a frequency of the antenna.

11. The antenna according to claim 1, wherein a difference value between a first value of the second inductance value and a second value of the second inductance value comprises $$\frac{X}{2\pi f},$$

wherein X comprises a reactance of the second oscillator, and wherein f comprises a frequency of the antenna.

12. The antenna according to claim 1, wherein a plurality of oscillators are disposed in an array.

13. The antenna according to claim 1, further comprising a third oscillator, and wherein the first oscillator, the second oscillator and the third oscillator are arranged in a triangle.

14. An antenna control method, applied to a first terminal comprising an antenna, wherein the antenna comprises a feeding part and at least two oscillators, wherein a circuit with a variable inductance value is separately disposed between each of the at least two oscillators and the feeding part, and wherein the method comprises:

obtaining a signal quality of a signal received by a user terminal, wherein the signal is sent from the antenna in a current antenna status;

obtaining a preset antenna status when determining that the signal quality is less than a preset quality threshold, wherein the preset antenna status comprises statuses of the at least two oscillators in the antenna; and sending control information to circuits with variable inductance values according to the statuses of the at least two oscillators in the preset antenna status, wherein the control information instructs the circuits with the variable inductance values to adjust the inductance values in order to switch statuses of the at least two oscillators to the statuses of the at least two oscillators in the preset antenna status.

15. The method according to claim 14, wherein after determining that the signal quality is less than the preset quality threshold, the method further comprises setting the current antenna status to an invalid antenna status, and wherein obtaining the preset antenna status comprises:

obtaining an antenna status with a highest priority from valid antenna statuses; and setting the antenna status with the highest priority to the preset antenna status.

16. The method according to claim 15, further comprising setting all antenna statuses to the valid antenna statuses when the signal quality is greater than the preset quality threshold.

17. The method according to claim 14, wherein an adjustable inductance line is disposed on the circuit with the variable inductance value, wherein an adjustable inductor is disposed on the adjustable inductance line, wherein the control information comprises a first target inductance value, and wherein the method further comprises adjusting, according to the control information, the adjustable inductor on the adjustable inductance line to the first target inductance value.

18. The method according to claim 14, wherein the circuit with the variable inductance value comprises a first line and a second line, wherein the first line and the second line are disposed in parallel, wherein an inductance value of the first line comprises zero, wherein an inductance value of the second line Is greater than zero, wherein the feeding part is coupled to a non-movable end of a single-pole, double-throw switch, wherein a movable end of the single-pole, double-throw switch can be coupled to the first line, wherein the control information comprises an identifier of a first target line, and wherein the method further comprises instructing, according to the control information, the movable end of the single-pole, double-throw switch to connect to the first target line.

19. The method according to claim 14, wherein the circuit with the variable inductance value comprises a first line and a second line, wherein the first line and the second line are disposed in parallel, wherein an inductance value of the first line comprises zero, wherein an inductance value of the second line is greater than zero, wherein the feeding part is coupled to a non-movable end of a single-pole, double-throw switch, wherein a movable end of the single-pole, double-throw switch can be coupled to the second line, wherein the control information comprises an identifier of a first target line, and wherein the method further comprises instructing, according to the control information, the movable end of the single-pole, double-throw switch to connect to the first target line.

20. An antenna system, comprising:

an antenna; and a radio frequency circuit coupled to the antenna, wherein the antenna comprises:

a feeding part;

a first oscillator;

a second oscillator, a first circuit with a variable inductance value is disposed between the first oscillator and the feeding part; and a second circuit with another variable inductance value is disposed between the second oscillator and the feeding part, wherein the first circuit comprises a first line and a second line, wherein an inductance value of the first line comprises zero, wherein an inductance value of the second line is greater than zero, wherein the first circuit comprising the first line and the second line can be switched between the first line and the second line, wherein the second circuit comprises a third line and a fourth line, wherein an inductance value of the third line comprises zero, wherein an inductance value of the fourth line is greater than zero, wherein the second circuit comprising the third line and the fourth line can be switched between the third line and the fourth line, wherein the first oscillator comprises an excitation oscillator and the second oscillator comprises an excited oscillator when an inductance value of the first circuit comprises zero and an inductance value of the second circuit comprises a first inductance value, wherein the first oscillator comprises the excited oscillator and the second oscillator comprises the excitation oscillator when the inductance value of the first circuit comprises a second inductance value and the inductance value of the second circuit comprises zero, wherein the excitation oscillator is configured to:

receive a signal from the feeding part; and emit the signal, and wherein the excited oscillator is configured to:

reflect the signal when a signal radiation direction of the antenna is from the excitation oscillator and away from the excited oscillator; and direct the signal when the signal radiation direction of the antenna is from the excitation oscillator and towards the excited oscillator.

* * * * *